United States Patent [19]

Okamoto et al.

[11] 4,233,596

[45] Nov. 11, 1980

[54] FLARE MONITORING APPARATUS

[75] Inventors: Hiroo Okamoto, Tokyo; Shunsaku Nakauchi, Mitaka, both of Japan

[73] Assignee: Showa Yuka Kabushiki Kaisha, Tokyo, Japan

[21] Appl. No.: 933,869

[22] Filed: Aug. 15, 1978

[30] Foreign Application Priority Data

Aug. 24, 1977 [JP] Japan ..... 52-101363

[51] Int. Cl.[2] ..... F23N 5/08; G01J 1/18

[52] U.S. Cl. ..... 340/578; 250/339; 250/554; 340/600; 431/14; 431/79

[58] Field of Search ..... 340/577, 578, 600; 250/339, 340, 349, 554; 431/12, 13, 14, 76, 79

[56] References Cited

U.S. PATENT DOCUMENTS

| | | | |
|---|---|---|---|
| 3,304,989 | 2/1967 | Alexander et al. | 431/79 X |
| 3,517,190 | 6/1970 | Astheimer | 250/339 |
| 3,716,717 | 2/1973 | Scheidweiler et al. | 340/578 X |
| 3,947,219 | 3/1976 | Santo | 340/578 X |
| 3,973,898 | 8/1976 | Seider | 431/12 X |
| 4,043,742 | 8/1977 | Egan et al. | 250/339 X |
| 4,043,743 | 8/1977 | Seider | 431/12 X |
| 4,160,163 | 7/1979 | Nakauchi | 250/339 |
| 4,160,164 | 7/1979 | Nakauchi | 250/339 |

FOREIGN PATENT DOCUMENTS 1960218 6/1971 Fed. Rep. of Germany .

*Primary Examiner*—John W. Caldwell, Sr.
*Assistant Examiner*—Joseph E. Nowicki
*Attorney, Agent, or Firm*—Bacon & Thomas

[57] ABSTRACT

A flare monitoring apparatus for detecting the generation of black smoke in a flare, the excessiveness of a flare and extinguishment of a flare based on the ratio and/or difference between an emissive power of infrared radiation emitted from a flare at a wave length at which a peak of the emissive power due to a resonance infrared radiation of a specified gas contained in a flue gas exists and an emissive power of infrared radiation emitted from the flare at another wave length at which a peak of the emissive power due to a resonance radiation does not exist. The apparatus produces an alarm and automatically controls the state of the flare upon the detection of the abnormality of the flare.

3 Claims, 2 Drawing Figures

FLARE MONITORING APPARATUS

Figure 1:
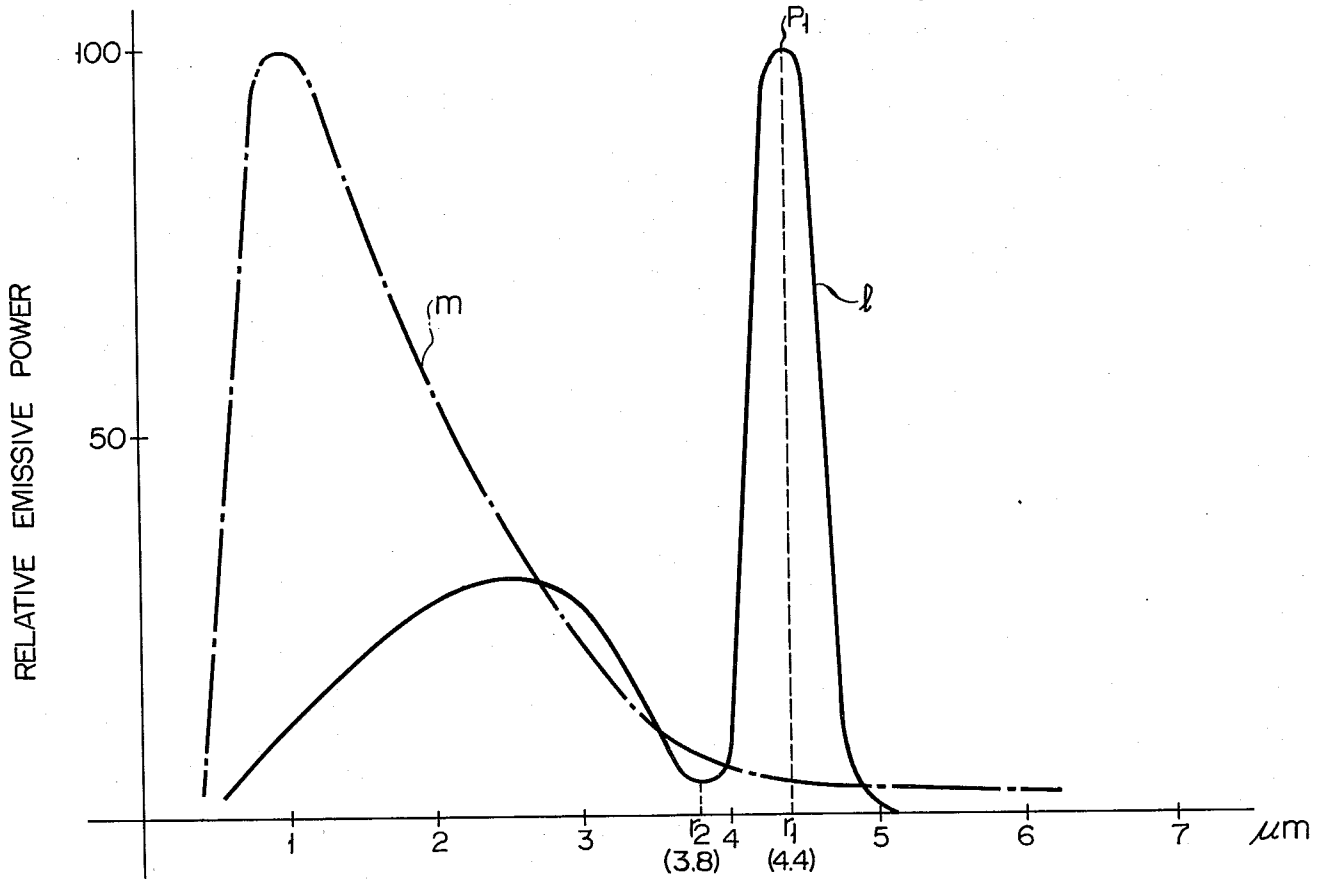

This invention relates to a flare monitoring apparatus, and more particularly to an apparatus of the type which monitors the state of a flare at a flare stack and produces an alarm and controls the burning state of a gas when the abnormality of the flare state is detected.

It is a common practice that a combustible gas vented from petroleum refinery plants or petrochemical plants is burned at a flare stack and disposed into the air. For prevention of environmental pollution and securing a safety, it is very important to monitor a state of the flare at the stack, i.e. black smoke generation, the size of flare, extinguishment of a pilot flame and the like and also to optimize the flare state.

Conventionally, a television camera is most commonly used to remotely monitor such a flare. In this method, however, a flare image screened on the television screen must always be observed with the eye. Thus, this method is improper when the flare monitoring system must be automated with labour saving. Additionally, it is particularly difficult to monitor the image of the flare on the screen by the eye at all times. Thus, it frequently causes one to fail to find an abnormality of the flare and to promptly take a proper countermeasure against the trouble.

To avoid this disadvantage, another method has been proposed by which the flare state is detected depending on the flow rate of a combustible gas flowing from the plant to the flare stack. This method detects the size of the flare based on the flow rate of the combustible gas, and prevents the black smoke generation by so controling an amount of a smokless steam being applied to the flare to promote the burning of the gas and prevent the black smoke generation as to meet it with an amount of the combustible gas. However, the composition of the gas vented from the plant changes greatly and irregularly and the amount of air necessary for complete combustion varies depending upon the change of the gas composition. Therefore, it is hardly possible to detect the abnormality of the state of flare by merely measuring the flow rate of combustible gas flowing from the plant to the flare stack.

Another proposal has been made in which an emissive power of an infrared radiation emitted from the flare at one wave length is measured and a state of flare is detected depending on the change of the emissive power. The infrared rays actually measured, however, includes infrared rays coming from the sun, cloud, and the like background, in addition to those from the flare itself. Therefore, it is very difficult to ensure a correct measurement by this method.

The flare stack keeps a pilot flame all times even when none of combustible gas is vented from the plant in order to promptly cope with a variation in the operating condition of the plant. If extinguishment of the pilot flame is overlooked and a large amount of combustible gas is exhausted without being burned, it mixes with air to form an explosive mixture. This is very dangerous. In fact, the pilot flame is very small and therefore it is very difficult to judge whether it is burning or extinguished through a television screen, and the pilot flame has no relationship with the flow rate of the combustible gas. Therefore, one frequently misses the extinguishment of the pilot flame and often fails to relight the pilot flame.

Accordingly, an object of the invention is to provide a flare monitoring apparatus in which a state of flare may be monitored easily and precisely, and an alarm is sounded when the flare state becomes abnormal so as to permit a prompt and proper countermeasure to be taken against the flare abnormality.

According to the invention, there is provided a flare monitoring apparatus comprising:

- a means for measuring a first emissive power of infrared radiation emitted from a flare at a first wave length at which a peak of emissive power due to a resonance infrared radiation from a specified gas contained in a flue gas in the flare exists and a second emissive power of infrared radiation emitted from the flare at a second wave length at which no peak of emissive power due to a resonance infrared radiation exists;
- a means for calculating the ratio and/or difference between said first and second emissive powers and for producing a signal or signals corresponding to said ratio and/or difference and representing a burning state of the flare;
- a means for detecting the generation of black smoke in the flare, excessiveness of the flare and the extinguishment of the flare based on said produced signal; and
- a means for producing an alarm in response to the result of the detection.

Figure 2:
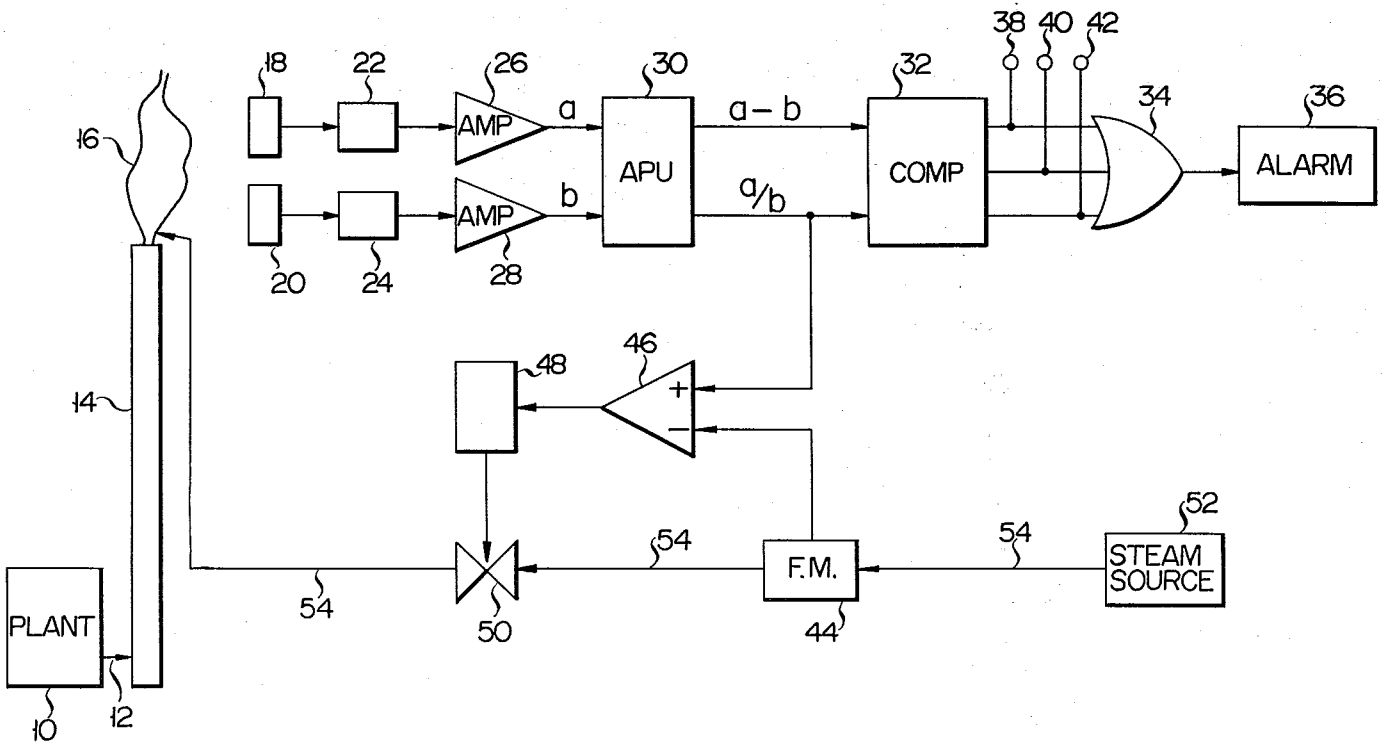

This invention will be more fully understood from the following detailed description when taken in conjunction with the accompanying drawing in which:

FIG. 1 shows graphs of emissive powers of infrared radiation to wave lengths for explaining the principle of this invention; and FIG. 2 shows a block diagram of an embodiment of a flare monitoring apparatus according to the invention.

Reference is first made to FIG. 1 to explain the principle of this invention. Generally, carbon monooxide or dioxide gas contained in a flue gas produced during burning of a substance emitts infrared radiation including an inherent resonance radiation. The infrared radiation has such an emissive power characteristic to wave lengths as indicated by curve l in FIG. 1. The characteristic curve l has a high peak P due to the resonance radiation. The resonance radiation does relate only to the burning state of the flare, which can be detected by measuring the emissive power of the resonance radiation.

The infrared rays existing around the flare generally originated not only from the flare itself but also from the sun, cloud and other background, and the emissive power of the infrared radiation varies with time and is different between night and day. Therefore, when one measures the infrared spectrums of specified wave lengths around the flare, it is hardly possible to correctly measure it in a usual manner. However, the infrared rays originated from the sun and the background not accompanied by flares have each an emissive power characteristic as shown by a curve m in FIG. 1. As seen from the comparison between the two curves l and m, both the curves are distinctively different in emissive power characteristics in the vicinity of the wave length $r_1$ at which the peak of the emissive power due to the resonance radiation exists. In the vicinity, the curve l steeply rises and falls off to form a peak P, while the curve m gradually decreases with wave length. The invention depends on this fact. More specifically, the emissive power a of infrared radiation at a wave length at which a peak of emissive power due to one resonance radiation inherent to the flare itself is measured. A second emissive power b of infrared radiation is measured at another wave length (reference wave length) at which no peak of emissive power due to the resonance radiation exists. Preferably the second emissive power is measured at a shorter wave length than $r_1$ and particularly at a wave length $r_2$ corresponding to the shortest wave length (the base) in the spectral band of the resonance radiation. Incidentally, the wave length $r_2$ is 3.8 μm in the case of carbon dioxide. Then, the ratio (a/b) or the difference (a−b) between the emissive powers a and b is calculated, and the result of the calculation is used as data to detect a state of flare. If an abnormal state of flare is detected, an alarm is sounded to provide a quick countermeasure against the abnormality.

When a flare has black smoke, this implies that gas undergoes an imperfect combustion and thus a great number of carbon particles exist in the flare. In this case, the intensity or emissive power a of the resonance radiation of carbon dioxide or monoxide in the flare decreases while the intensity or emissive power b of the infrared radiation from carbon particles, i.e. high temperature solid, increases. Therefore, the emissive power of the infrared radiation at the wave length $r_2$ relatively increases. At this time, if the ratio of the emissive powers, a/b, is calculated, one can see from the ratio whether black smoke is produced or not.

Generally, smokeless steam is blown into a flare for purpose of temperature rise and stiring of gas to be supplied to the flare during the burning of gas at a flare stack. When black smoke is detected by the abovementioned method, the flow rate of the smokeless steam may automatically be adjusted by using the data obtained. This is useful for prevention of environmental pollution. Further, a process in which a flare is monitored and the steam amount is adjusted depending on the result of the monitor may fully be automated by using the invention. There is a case where, although no black smoke is actually observed in a flare, imperfect combustion takes place in the flare. In such a case, carbon particles in the flare increases and thus the ratio a/b decreases. As seen from the foregoing, the invention is applicable for such a case. Accordingly, if the flare monitoring apparatus according to the invention is used, possible generation of black smoke is detected at an earlier stage and the real generation of it may be prevented by properly adjusting the flow rate of the steam.

When a flare grows excessively, the resonance radiation intensity a becomes large so that the ratio (a/b) or the difference (a−b) also increases. Therefore such an abnormality may be detected from the change of the ratio or the difference.

When the flare extinguishes, high temperature carbon monoxide or dioxide completely disappears, and thus there is no resonance radiation emitted from them. Based on this fact it can be detected whether the flare extinguishes or not.

An embodiment of the flare monitoring apparatus according to the invention will be described with reference to FIG. 2. In the figure, a petrochemical plane 10 supplies combustible gas such as methane and $C_4$ fraction through a pipe 12 to a stack 14 where the gas is burned. A flare during burning is designated by reference numeral 16. A couple of sensors 18 and 20 are disposed, confronting the flare 16. These sensors are, for example, band-pass filters or infrared ray sensors and are capable of sensing the infrared radiation at a specified wave length, for example, 4.4 μm ($r_1$) of the resonance radiation of carbon monoxide and 3.8 μm ($r_2$) at the base of the spectral band of the resonance radiation. The infrared radiations sensed by the sensors 18 and 20 are converted into electric signals with corresponding magnitudes by means of photoelectric converters 22 and 24, respectively. These signals are amplified at the same amplitudes by amplifiers 26 and 28 to be intensity signals a and b, respectively. These signals a and b are applied to an arithmetic processing unit 30 where the difference (a−b) and/or the ratio (a/b) of these signals are calculated and the calculated a/b and a−b are inputted into a comparator 32. The comparator 32 checks whether each of these falls within a predetermined range. In a normal state of the flare, the ratio or the difference falls within the predetermined range having an upper limit of α. When the flame grows excessively, the intensity of the resonance radiation increases so that the a/b or a−b exceeds the upper limit alpha (α). In other words, when the ratio or the difference exceeds the upper limit alpha (α), the comparator 32 produces an output signal. The production of the output signal indicates the excessively grown flare. When the flare extinguishes and gas combustion completely disappears, the intensity difference a−b between two infrared radiation at the wave lengths $r_1$ and $r_2$ becomes equal to the intensity difference between infrared radiations from the sun. The difference a−b in this case takes a minus value in the day time as seen from FIG. 1, and is zero in the night time. Accordingly, in this case, 0 level is used for the reference value of the comparator 32 and when the difference a−b becomes equal to or below the 0 level, it produces an output signal. The production of the output signal indicates the extinguishment of the flare.

In a normal state of the flare, the ratio (a/b) falls within a range with the lower limit beta (β). When imperfect combustion expands in the flame, the carbon particles increase as previously stated and thereby the intensity signal a of the resonance radiation decreases and therefore the ratio a/b falls below the lower limit (β). Thus, in this case, the comparator 32 is so designed that the lower limit beta is used for the reference value and when the ratio a/b is below the beta (β), it produces an output signal.

Thus produced output signals from the comparator 32 pass through an OR gate 34 to reach an alarm 36 thereby to sound an alarm. Lamps 38, 40 and 42 are connected with the output lines of the comparator 32, respectively. When seeing the activated lamp, one can directly know the state of flare; black smoke, excessively grown flare or extinguishment of flare.

A signal representing the intensity ratio a/b calculated by the arithmetic processing unit 30 is applied to the input of an operational amplifier 46, together with a flow rate signal f delivered from an electromagnetic flow meter 44 measuring a flow rate of a smokeless steam being supplied from a source 52 to the flare 16 through a pipe 54. Upon receipt of these signals, the operational amplifier 46 produces an output signal representing the difference between the ratio a/b and the signal f. The difference signal is applied to a servo system 48 for driving it. The servo system thus driven in turn controls correspondingly the open and close of a valve 50, with the result that the flow rate of the smokeless steam flowing through the pipe 54 is properly adjusted to prevent black smoke from generation.

As seen from the foregoing description, the flare monitoring apparatus according to the invention eliminates the constant monitoring work of the flare state when using television. Further, the flare monitoring may highly precisely be made and is free from an erroneous operation due to the external infrared rays coming from the sun and the like. Therefore, the invention ensures an excellent flare monitoring and labour saving and enables the monitoring process to be fully automated. Additionally, the flare monitoring may be carried out independently of change of the composition of flare gas or the flow rate thereof.

The resonance radiation of carbon dioxide used in the example mentioned above may be replaced by that of carbon monoxide generated in burning. Incidentally, the highest peak of emissive power due to the resonance radiation of carbon monoxide appears at the wave length of 4.7 $\mu$m. Further, the reference wave length is not limited to only one. For example, in addition to the wave length $r_2$, another reference wave length $r_3$ may be used which is different from the $r_2$ and that of the resonance radiation. In this case, the ratios a/b and b/c or the differences a−b and b−c are used with the result that the precision of the flare monitoring is improved. Here, a, b and c are the intensities of respective infrared radiation, respectively.

Furthermore, the chemical composition of the flare gas burning at the flare stack may also be estimated by using the flare monitoring apparatus according to the invention. An amount of air necessary for complete combustion of combustible gas varies with the gas composition. Therefore, the flow rate of gas above which black smoke is produced, also changes depending on the gas composition. For example, the flow rate of methane at which black smoke begins to produce is lower than that of $C_4$ fraction. Accordingly, if the flow rate of flare gas flowing from the plant 10 into the flare stack 14 is measured by means of a proper flow meter when the flare monitoring apparatus of the invention detects the generation of black smoke, it is possible to estimate the chemical composition of the gas at that time. In the case where the flow rate of the smokeless steam is automatically controlled as in the above-mentioned example, the chemical composition of the gas may be estimated from the ratio of the gas flow rate $Q_1$ when the ratio a/b indicates a value within a fixed range, to the flow rate $Q_2$ of the smokeless steam at that time. The reason is that a gas with such a composition as to need much air for combustion tends to be in imperfect burning even when the gas flow rate $Q_1$ is relatively low. Therefore, in order to keep the burning in a proper state under such a condition, the flow rate $Q_2$ of the smokeless steam must inevitably be large so that the ratio $Q_2/Q_1$ becomes large.

What we claim is:

1. A flare monitoring apparatus comprising:

a means for measuring a first emissive power of infrared radiation emitted from a flare at a first wave length which a peak of emissive power due to a resonance infrared radiation from a specified gas contained in a flue gas in the flare exists and a second emissive power of infrared radiation emitted from the flare at a second wave length at which no peak of emissive power due to a resonance infrared radiation exists;

a means, responsive to said measuring means, for calculating the ratio or difference between said first and second emissive powers and for producing signals corresponding respectively to said ratio and differencc and representing a burning state of the flare including the generation of black smoke in the flare, excessiveness of the flare and the extinguishment of the flare;

a means for detecting the burning state of the flare including a comparator which receives said signals from said calculating means for producing an output signal when said signals exceed or fall below predetermined reference levels; and an alarm for receiving said output signal from said detecting means and producing an alarm;

wherein the generation of black smoke in the flare is detected based on said ratio, and the excessiveness of the flare and the extinguishment of the flare are detected based on said difference.

2. An apparatus according to claim 1, comprising a means for controlling the flow rate of a smokeless steam being supplied to the flare so as to prevent the generation of black smoke in said flare when said signal from said calculating means corresponding to said ratio deviates from one of said predetermined levels.

3. An apparatus according to claim 1 or 2, wherein said specified gas is carbon monoxide or dioxide.

* * * * *